United States Patent [19]

Eisermann et al.

[11] 4,241,905

[45] Dec. 30, 1980

[54] HEAD OR SLIDE PLATE FOR A MOLTEN-METAL SLIDE GATE

[75] Inventors: Eckehard Eisermann, Grefrath; Dieter Beckers, Neunkirchen, both of Fed. Rep. of Germany

[73] Assignee: Martin & Pagenstecher GmbH, Cologne, Fed. Rep. of Germany

[21] Appl. No.: 55,512

[22] Filed: Jul. 9, 1979

[30] Foreign Application Priority Data

Jul. 10, 1978 [DE] Fed. Rep. of Germany ..... 2830199

[51] Int. Cl.[3] ..... C21C 5/42

[52] U.S. Cl. ..... 266/236; 222/597; 222/599; 251/301; 251/326

[58] Field of Search ..... 266/236, 271, 272, 287; 251/326, 327, 301, 302; 48/55; 51/30; 222/597, 599

[56] References Cited

U.S. PATENT DOCUMENTS

| | | | |
|---|---|---|---|
| 2,943,370 | 7/1960 | Murarsheed | 266/272 |
| 4,054,411 | 10/1977 | Beck | 266/271 |

*Primary Examiner*—L. Dewayne Rutledge
*Assistant Examiner*—John P. Sheehan
*Attorney, Agent, or Firm*—Kenyon & Kenyon

[57] ABSTRACT

A head or slide plate for a molten-metal slide gate is formed by a refractory plate having an opening and a refractory ring positioned in the opening, with a ring of tar between the peripheries of the opening and refractory ring and which is isolated from the plate surfaces excepting for a passage filled with a porous refractory and through which the vaporized tar migrates to one of the slide surfaces when the plate and ring are heated by contact with the molten metal.

4 Claims, 2 Drawing Figures

HEAD OR SLIDE PLATE FOR A MOLTEN-METAL SLIDE GATE

BACKGROUND OF THE INVENTION

Slide gates are used for the casting openings of steel-casting ladles. The slide gate is closed when the molten steel is poured into the ladle and is opened for casting of the molten metal.

A slide gate comprises a refractory head plate having an opening for passage of the molten metal and a refractory slide plate beneath the head plate and also having an opening so that by sliding the plate one way or another the head plate opening is blocked or opened. The slide plate is positioned and slidably guided by guideways fixed to the ladle bottom. The interfacing surfaces of the two refractory plates are flat to make the sliding action possible. The two refractory plates, which may be made of ceramic material, are directly contacted by the molten metal and thereby heated to the metal's casting temperature.

The prior art includes a proposal that one or both of the refractory plates be impregnated with tar to provide the following advantages:

1. Reduction of the infiltration of slag and steel;
2. Improvement of the closing behavior and sliding behavior as a result of sperficially vaporizing tar constituents; and
3. Improvement of the spalling resistance of the ceramic material, for example a reduced tendency to form cracks.

However, there are objectionable features. The vaporized tar is driven off in excessive volumes and condenses on the parts of the slide gate so that with objectionable frequency the gate must be dismantled and cleaned from the condensed tar. This is an unpleasant task for the workman and prevents use of the ladle until the slide gate can be reassembled and again ready for use. In addition, a redundant amount of tar is involved, the result being dirty plumes of tar vapor which rise and present an environmental problem to the workmen.

The slide plate is in its closed position when the molten steel is poured in the ladle and is subjected to a large and sudden temperature change. Temperature measurements have shown that there is a temperature gradient of from 1600° C. to about 300° C. over the length of the slide plate. The head plate presumably is subjected to a corresponding temperature gradient throughout its length. As a consequence, the refractory ceramic plates receive high thermal strains and these strains have caused spider-like cracks in the plates.

The object of the present invention has been to develop a more satisfactory slide and/or head plate for such a molten metal slide gate and which provides the advantages of the use of the tar while eliminating or at least materially reducing the tar's disadvantages as well as the development of the spider-like cracks in the refractory plates.

SUMMARY OF THE INVENTION

According to this invention, the head or slide plate comprises a refractory ceramic plate having a circular opening and a refractory ceramic ring positioned in this opening and internally forming the passage for the molten metal. The plate and ring cooperatively form a flat slide surface as required for the plate on the flat slide surface of the other plate, the opposite surfaces of the two parts forming a base surface.

The respective peripheries or annular edge portions of the plate's opening and ring are shaped so as to cooperatively form an annular chamber spaced between the slide surface and base surface and separated from these two surfaces by the refractory ceramic material of the two parts, and in addition, these peripheries are shaped or dimensioned to form an annular passage extending axially from that chamber to the slide surface of the plate.

Contrasting with the prior art, the described refractory ceramic parts are not impregnated with the tar. Instead, a tar ring is positioned in the annular chamber for vaporization when the ring and plate are heated by the molten metal, the tar vapors passing through the annular passage to the slide surface of the plate. The vapor flow through this passage is choked or controlled by the passage being filled with a porous refractory material through which the vaporized tar migrates to the plate's slide surface.

When in use, only controlled volumes of the tar vapor reach the slide surface of the plate, control being effected by adjusting the permeable characteristics of the porous refractory.

In this way the production of excessive tar vapor is avoided. The service life of the plate is longer because it does not become so quickly contaminated by condensed tar on its working surfaces. In addition, the porous refractory, which can also be used between the two peripheries on the base surface side of the plate, has been found to effectively reduce the previously described thermal straining and consequently to reduce, if not eliminate, the spider-like crack formations. A porous ceramic material does not have the high heat conductivity of the dense ceramic material required for the plate and ring to obtain the necessary mechanical strength needed by these parts.

For the execution of these fundamental concepts, the invention provides for construction details and other advantages, illustrated and described by the accompanying drawings and following specification.

DESCRIPTION OF THE DRAWINGS

In these accompanying drawings

DETAILED DESCRIPTION OF THE INVENTION

Figure 1:
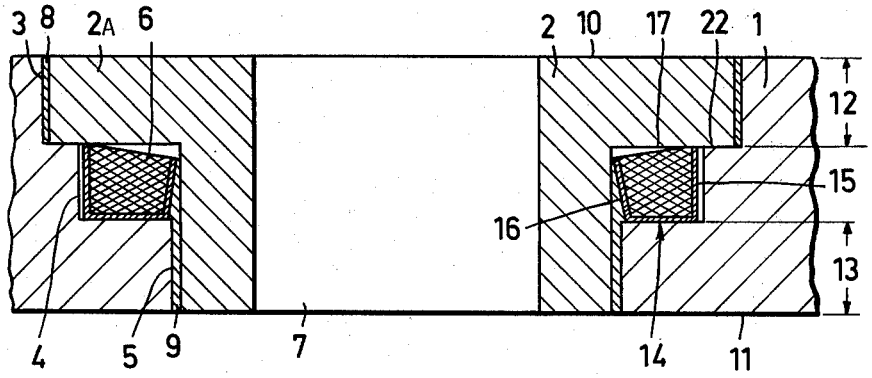
FIG. 1 is a vertical section through a slide gate embodying the invention and showing only the ring and plate portion which involve the invention's principles.

Only the slide plate is illustrated because the head plate can be made the same way.

This slide plate 1 is provided with the previously mentioned ring 2 here shown as having a flange 2*a* positioned in a circular opening formed by the plate having a counterbore 3 on the bottom of which the flange 2*a* is supported. A second counterbore 4 in the plate 1 has a diameter smaller than the counterbore 3, but larger than the refractory ring's diameter so that between the second counterbore's bottom and the bottom side of the flange 2*a* the annular chamber is formed. The balance 5 of the plate's opening provides an inside diameter slightly larger than the outside diameter of the ring, this also applying to the diameter of the first counterbore 3 and the outside diameter of the flange 2*a*.

The tar ring 6 is positioned on the bottom of the second counterbore 4 in the annular chamber. The inside diameter of the ring 2 is proportioned as required to form the molten metal passage 7. The annular space formed between the interfaces of the flange 2*a* and counterbore 3 is filled with the porous refractory 8, and the space between the balance of the plate 5 and the outside of the ring 2 is also filled with a porous refractory 9. The flat slide surfce 10 is cooperatively formed by the tops of the plate 1 and ring 2, the bottom side 11 of the plate and ring forming a base surface illustrated as being flat and parallel to the surface 10.

The flange and counterbores are proportioned so that the tar ring 6 is positioned at a substantial distance 12 from the plate's slide surface 10, and at a substantially equal distance 13 from the plate's bottom or base surface 11.

Preferably the tar ring 6 is provided with a sheet metal shell 14 having upstanding sides 15 and 16 but leaving the top of the ring open below the bottom 17 of the flange 2*a*.

Figure 2:
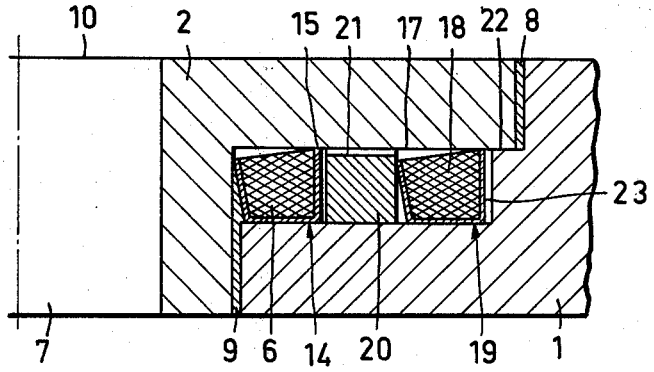
FIG. 2, also a vertical section, shows a modification.

In FIG. 2, a second tar ring 18 is added to the tar ring 6 with appropriate proportioning of the ring's flange and of the plate counterbores. As in the case of the tar ring 6, the tar ring 18 is encased as to its sides and possibly its bottom by a steel shell 19.

With the two tar rings 6 and 18 annularly separated, it is possible to put a ceramic ring 20 in between the two for supporting the flange 2 relative to the plate 1, this support otherwise depending on the ring flange bearing on the bottom of the first counterbore. This refractory support ring 20 can be provided with radial grooves 21 in its surface on which the ring's flange bears to assure that the tar vapor from the ring 6 can travel radially outwardly. The abutting surfaces indicated at 22 are radially of short length, and while providing for supporting the ring from the plate, do not unduly impede the radial outward passage of the tar vapor to the axially extending annular passage filled with the porous refractory 8 and through which the tar vapor can migrate or permeate so as to spread over the slide surface 10. However, although not illustrated, the abutting surfaces 22 can also be provided with grooves radially extending to the bottom of the axially extending annular passage 8 filled with the porous material. The outer steel shell wall 15 in FIG. 1 and 23 in FIG. 2 should either terminate a little below the bottom of the ring's flange, be serrated, or otherwise designed to assure that the tar vapor can flow outwardly to the inner end of the axially extending annular passage leading to the sliding surface 10. The purpose of the steel shell or shells provided for the tar ring or rings is to prevent undue loss of tar and tar vapor in directions other than radially outwardly to the passage leading to the slide surface.

In operation, when the slide plate is opened, the ring 2 is suddenly exposed directly to the heat of the molten metal flowing through the passage 7. The porous refractories 8 and 9 have lower heat conductivity than the dense and hard ceramic from which the ring 2 must be made for strength. These thermal barriers prevent the plate 1 from receiving the thermal shock involved, as suddenly as in the case of the prior art head or slide plate designs. The plate cracking trouble is eliminated or reduced. As the ring 2 heats, and although at a relatively slower rate heats the plate 1, the tar ring 6, or the rings 6 and 18 in the case of FIG. 2, become heated so as to vaporize, the vapor being substantially blocked from flow in all directions excepting upwardly and radially outwardly to the inner end of the radial passage 8. The vapor, pressurized by the heat, flows slowly or migrates through the annular passage 8 via the porous refractory material which controls the flow. Variations in the porosity for the refractory, within the skill of the art, can be resorted to to control the flow rate of the tar vapor to the surface 10. The radially inner wall of the steel shell for the tar ring can be made so that some of the tar vapor flows, under the control of the porous refractory 9, to the base 11 of the plate, should this be desired. For example, in the case of a head plate, it might prove to be desirable to have the refractory ring 2 supported by the shoulder or bottom of the first counterbore so that the stress created by molten steel pouring through the opening of the heated plate need not be borne entirely by the supported ring of the slide plate below. In such instance, the head plate, without inversion, might be used as shown in the case of the slide plate illustrated by the drawings.

The tar ring or rings can consist of commercially available steel-works tar. Characteristically, this has a pitch content of between 50 and 95% by weight, and for use with the present invention, would preferably have about 95% by weight of pitch. The softening point is between 25° C. and 100° C. and for the present invention preferably at about 50° C. Depending on the pitch content, different percentages of light oils, middle oils, heavy oils and anthracene oils may be included by the tar.

The porous refractory indicated at 8 and 9 can be hydraulically or chemically setting materials with alumina contents between 50 and 95% by weight, preferably about 90%. When the ring is positioned in the opening in the plate, with the respective diameters related to leave the two spaces extending axially in opposite directions from the tar ring or rings, this mortar can be rammed or injected into the two spaces involved and allowed to set and thoroughly dry before the plate is put to use.

For a slide gate of typical size, the radial thickness of the resulting mortar annular layers is preferably from 0.5 to 5 mm, 2 mm being considered preferable. The tar ring may range in thickness from a minimum of 5 mm, but 10 to 20 mm is considered preferable.

The ceramic material used for the refractory plate and ring can be any of those conventionally used for the prior art head and slide plates. These ceramics may consist, for example, of mullite, corundum and clay, and preferably have an alumina content of about 90% by weight. The ring 2 should in particular be of as dense and strong a ceramic as is possible.

As illustrated, the porous refractory 9 is extended upwardly so as to provide thermal insulation between the tar ring and the ceramic ring 2, and the tar ring's inner periphery angles or flares upwardly so that the top of the tar ring 6 the tar directly contacts the ceramic ring 2 which is directly heated by the molten metal. Therefore, the top of the tar ring vaporizes first, followed by vaporization of the low tar portion.

This new plate lasts longer than the tar-impregnated plate, gives effective use of the tar, produces less smoke, and does not produce excessive tar vapor too quickly requiring cleaning of the gate valve from condensed tar deposits.

What is claimed is:

1. A molten metal slide gate comprising head and slide plates, one of said plates comprising a refractory plate having a circular opening and a refractory ring positioned in the opening, one side of the plate and ring cooperatively forming a flat slide surface, the respective peripheries of the opening and ring being shaped so as to cooperatively form an annular chamber spaced between the opposite sides of said one of the plates and the slide surface and an annular passage extending axially from the chamber to the slide surface, a tar ring positioned in the chamber and which vaporizes when the refractory ring is heated by molten metal, and porous refractory filling the annular passage and through which the vaporized tar can migrate to the slide surface.

2. The plate of claim 1 in which on the slide surface side the ring's periphery has an outwardly extending flange, the periphery of the refractory plate having a counterbore on the bottom of which the flange is supported and a second counterbore having diameter that is smaller than the first counterbore and larger than the refractory ring's outside diameter so as to form the annular chamber, the flange's periphery being radially spaced from the side of the first counterbore to form the annular passage, the interfaces of the first counterbore's bottom and the flange providing for radially outward volatilize tar flow to the annular passage.

3. The plate of claim 1 in which the tar ring is enclosed by sheet metal excepting for its portion facing the flange's inner side.

4. The plate of claims 1, 2 or 3 in which two radially interspaced tar rings are positioned in the chamber and a refractory support ring is positioned between the tar rings and supports the flange via the second counterbore's bottom.

* * * * *